US005672853A

United States Patent [19]

Whitehall et al.

[11] Patent Number: 5,672,853

[45] Date of Patent: Sep. 30, 1997

[54] ELEVATOR CONTROL NEURAL NETWORK

[75] Inventors: Bradley L. Whitehall, Glastonbury; David J. Sirag, Jr., South Windsor; Bruce A. Powell, Canton, all of Conn.

[73] Assignee: Otis Elevator Company, Farmington, Conn.

[21] Appl. No.: 643,397

[22] Filed: May 6, 1996

Related U.S. Application Data

[63] Continuation of Ser. No. 224,224, Apr. 7, 1994, abandoned.

[51] Int. Cl.[6] ..... B66B 1/16; B66B 1/18; B66B 1/34

[52] U.S. Cl. ..... 187/380; 1987/393; 1987/382

[58] Field of Search ..... 187/380, 382, 187/387, 391, 393

[56] References Cited

U.S. PATENT DOCUMENTS

| | | | |
|---|---|---|---|
| 4,815,568 | 3/1989 | Bittar | 187/127 |
| 5,010,472 | 4/1991 | Yoenda et al. | 364/148 |
| 5,146,053 | 9/1992 | Powell et al. | 187/127 |
| 5,182,776 | 1/1993 | Suzuki et al. | 382/14 |
| 5,250,766 | 10/1993 | Hikita et al. | 187/123 |
| 5,252,789 | 10/1993 | Siraq, Jr. | 187/124 |
| 5,306,878 | 4/1994 | Kubo | 187/127 |
| 5,409,085 | 4/1995 | Fujino et al. | 187/380 |
| 5,412,163 | 5/1995 | Tsuji | 187/382 |

FOREIGN PATENT DOCUMENTS

| | | | |
|---|---|---|---|
| 0565864 | 10/1993 | European Pat. Off. | B66B 1/20 |
| 0572926 | 12/1993 | European Pat. Off. | B66B 13/14 |
| 04028681 | 1/1992 | Japan . | |
| 069543 | 3/1995 | Japan . | |
| 2237663 | 5/1991 | United Kingdom | B66B 1/20 |
| 2245997 | 1/1992 | United Kingdom . | |
| 2246214 | 1/1992 | United Kingdom . | |
| 2266602 | 11/1993 | United Kingdom | B66B 1/20 |

OTHER PUBLICATIONS

Copy of EPC Search Report Serial No. 95301950.2 dated Jul. 9, 1996.

English Translation of Abstract For Japanese Patent No. 07–069543 published Mar. 14, 1995 (see Foreign Patent above).

"Computer Systems That Learn" by S.M. Weiss and C.A. Kulikowski Chapter 4, Neural Nets, pp. 81–91.

"Parallel Distributed Processing Explorations in the Microstructure of Cognition, vol. 1: Foundations" by David E. Rumelhart, et al pp. 390–411.

"An Introduction to Neural Networks and a Comparison with Artificial Intelligence and Expert Systems" by Eatemeh Zahdei; Interfaces 21: 2 Mar.–Apr. 1991 —pp. 26–38.

"Fuzzy Logic A New Way of Thinking About the Complexities of Dispatching Elevators" by B.A. Powell and D.J. Shirag Jr., Sep. 93/Elevator World, pp. 78–84.

"The Total Least Squares Problem Computational Aspects and Analysis" by S. Van Huffel, et al. Society for Industral and Applied Mathematics, Philadelphia, 1991, pp. 1–5.

"Elementary Linear Algebra" by Paul C. Shields, Dept. of Mathematics Wayne State University; School Mathematics Study Group, Stanford University; Worth Publishers, Inc.; pp. 40–42.

"Elementary Matrices and Some Applications to Dynamics and Differential Equations" by R.A. Frazer, et al, Cambridge at the University Press 1957; pp. 125–127.

"Neural Networks: Computer Toolbox for the '90s" by Tim Studt; R&D Magazine, Sep. 1991, pp. 36–42.

*Primary Examiner*—Robert Nappi

[57] ABSTRACT

A remaining response time for an elevator car under consideration for assignment to a newly registered hall call is estimated by using a neural network. The neural network or any other downstream module may be standardized for use in any building by use of an upstream fixed length stop description that summarizes the state of the building at the time of the registration of the new hall call for one or more postulated paths of each and every car under consideration for answering the new hall call.

13 Claims, 10 Drawing Sheets

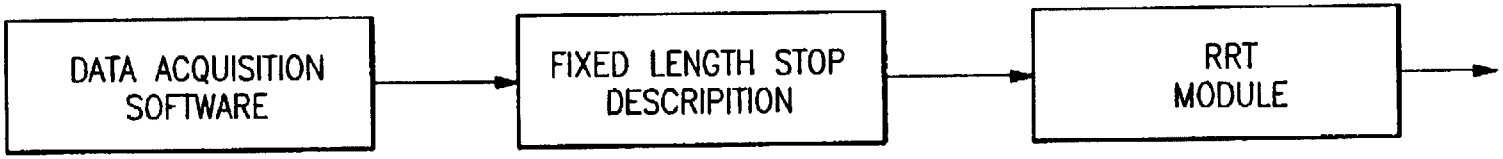
FIG.7
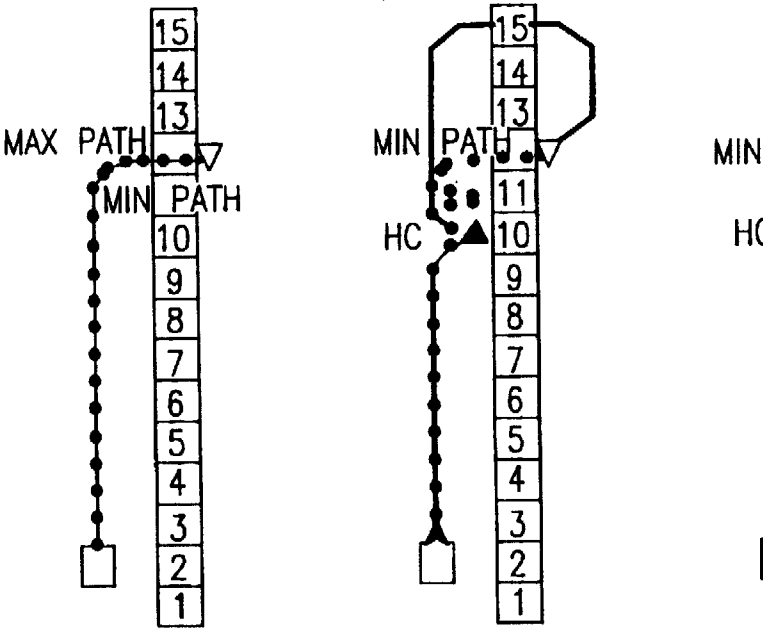
NO COMMITMENTS
FIG.16
HC BELOW
FIG.17
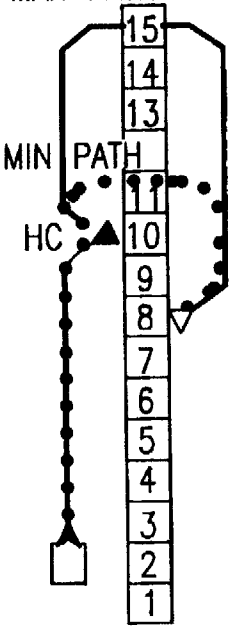
HC ABOVE
FIG.18
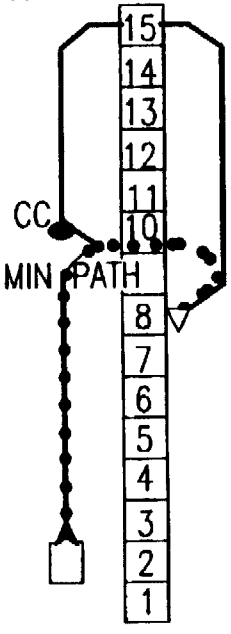
CC ABOVE
FIG.19
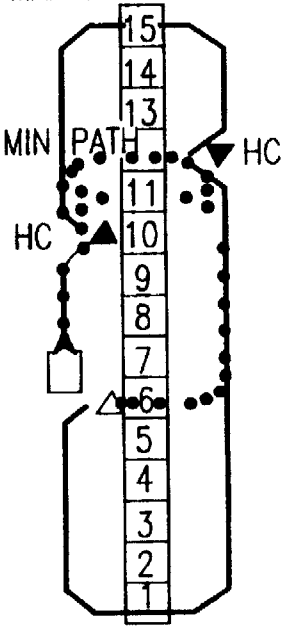
TWO HCs
FIG.20

FLSD TABLE FOR MAX PATH
RRT (CAR A I ▽ FLOOR 8)

ELEVATOR CONTROL NEURAL NETWORK

This application is a continuation of application(s) Ser. No. 08/224,224, filed on Apr. 7, 1994, now abandoned.

TECHNICAL FIELD

This invention relates to elevators and, more particularly, to dispatching plural elevators in buildings.

BACKGROUND OF THE INVENTION

Elevator dispatching systems use a number of factors in determining which car is the most appropriate to service a request (hall call). Since conditions are constantly changing, such systems evaluate and reevaluate the best car to serve a hall call "on-the-fly", so that a final selection need not be made until the last possible moment. See, e.g., U.S. Pat. No. 4,815,568 to Bittar. Remaining response time (RRT) may be defined as the amount of time it will take for a car to travel from its current position to the floor with the outstanding hall call and is an important, but not critical, element in determining the best assignment. See, e.g., U.S. Pat. No. 5,146,053 to Powell. After data acquisition, RRT may be estimated and used by the car assignment software as merely one factor in selecting an assignment, as shown in FIG. 2.

In instant car assignment (ICA) dispatching systems, on the other hand, an accurate estimate of remaining response time at the time of hall call registration is critical to ensuring an appropriate response because the assignment may not usually be switched at a later time. An accurate estimate of RRT for ICA assignment systems can ensure that the best assignment is made, thus improving the overall efficiency of the elevator system.

The advances described in this disclosure were developed because current methods of estimating remaining response time lack the accuracy needed to meet the performance demands of ICA systems. Remaining response time is currently calculated by using the distance to be traveled, the number of known stops on the path, and the speed of the elevator. This is inadequate because other relevant factors are not included in the calculations. In addition, the RRT calculation is static and does not change as conditions in the elevator system change. For example, during heavy traffic periods stops take more time, and this difference is not currently recognized in RRT calculations. These difficulties suggest that a new approach to computing RRT be used, one which takes into account the subtle influences of many factors and changing conditions.

DISCLOSURE OF INVENTION

An object of the present invention is to provide a new method of predicting response time of an elevator car to a hall call.

Another object of the present invention is to provide such a new method of estimating response time that can be transferred from building to building without alteration.

According to a first aspect of the present invention, remaining response time is provided by a neural network.

Artificial neural networks (ANN) are able to learn complex functions involving a large number of inputs when provided with training data. When provided with the proper inputs, an ANN is able to compute a more accurate estimate for RRT, which in turn allows a better car assignment to be made. A neural network as shown in FIG. 3, for example, typically consists of one or more "neurons" or nodes interconnected to calculate the desired output from a weighted combination of the input values. Such has been described in "Parallel Distributed Processing: Explorations in the Microstruction of Cognition. Vol. 1: Foundations", Cambridge Mass.: MIT Press/Bradford Books, 1986, by D. E. Rumelhart et al. The weights associated with the links between nodes determines how well the network performs. Neural networks can "learn" what the appropriate weights should be via training. In neural networks the training data consists of an input vector and the corresponding desired output for each of the input vectors. The learning algorithm adjusts the weights $w_i$ until the actual output matches the desired output of the network. Back propagation is described by Rumelhart et al and comprises a standard neural network learning algorithm, measuring the difference between the desired output and the actual output for a particular training case and determining small changes in the weights that would correct for the observed error. A new training case is then selected from the training set, and this process is repeated until the weights converge to steady state values. It may take many iterations for this convergence to occur. For simple networks, as opposed to multi-layer networks, direct linear regression techniques can be used to determine network weights instead of back propagation. The linear regression approach eliminates uncertainty about when the network has finished learning and provides a single repeatable solution from a given training set. See, for example, "Computer Systems That Learn", Chapter 4, Neural Nets, Sections 4.1–4.1.1, by S. M. Weiss et al.

A number of different architectures can be specified for a neural network. The most common are feed-forward networks, where the outputs of a node are passed only to nodes higher in the hierarchy. Other architectures are described by Rumelhart et al and the present invention is not limited to feed-forward networks. The advantage of feed-forward networks is that the training algorithms for them are well studied.

Artificial neural networks are able to induce a generalized model from the training data. That model is specified by the values in the weights. The model is constructed to meet specific criteria provided during the training phase, such as to minimize the sum of squared error for all examples.

Currently, systems using information about the state of the elevator system must be modified for every installation to account for the number of floors in the building and the number of cars in the group.

According to a second aspect of the present invention, a subset of input signals relating to a corresponding subset of floors along a selected elevator car path in a building are organized for providing a fixed number of output signals indicative thereof, regardless of the number of the input signals in the subset.

According further to this second aspect of the present invention, a method for filtering a plurality of input signals for use in constructing a concise, fixed length description of a building state, comprises the steps of specifying a subset of floor/direction combinations along a selected path, collecting input signals associated with each floor/direction combination in this subset, incrementing a cell in a fixed length stop description table corresponding to a current state of the floor/direction combination, and providing a completed table of output signals.

This second aspect of the present invention provides a method for filtering the plurality of input signals for use in dispatching, regardless of the size of the building and number of cars therein. It should be understood that although the above described method of filtering is disclosed in detail in regard to its use with a neural network, it should be understood that it can be used in combination with other techniques besides neural networks.

These and other objects, features and advantages of the present invention will become more apparent in light of the following detailed description of a best mode embodiment thereof, as illustrated in the accompanying drawing.

BRIEF DESCRIPTION OF THE DRAWING

FIG. 7 is similar to FIG. 2 except showing, according to the use of the present invention, a fixed length stop description (FLSD) block interposed between the data acquisition software and the RRT module and further distinguished from FIG. 2 in that the RRT module may be a neural network or carries out the functions of a neural network on the programmed signal processor of FIG. 5, according to the present invention.

FIGS. 16–20 illustrate some examples of minimum and maximum paths such as may be used in a fixed length stop description, according to the present invention.

BEST MODE FOR CARRYING OUT THE INVENTION

Figure 1:
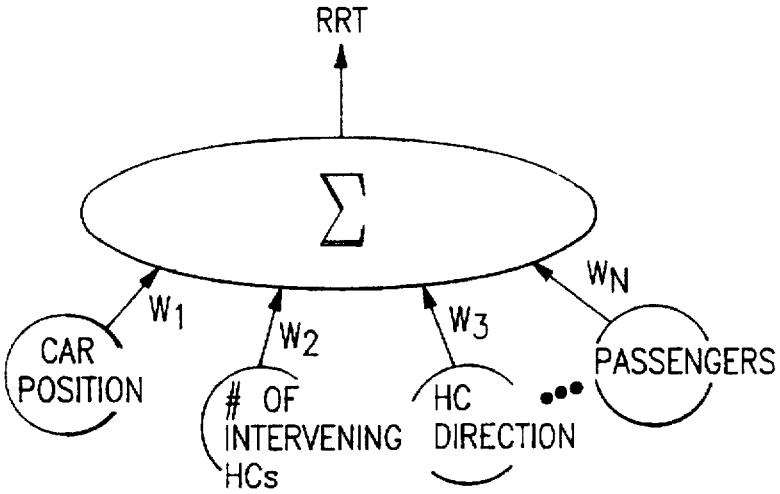
FIG. 1 shows an artificial neural network (ANN) for estimating remaining response time (RRT) of an elevator car, according to the present invention.

The artificial neural network (ANN) aspect of the present invention, as shown in FIG. 1, is able to take into account a large number of factors and empirically determine their importance in estimating the remaining response time (RRT) for an elevator car.

The network disclosed herein for estimating RRT is a linear perception, but the invention is not restricted thereto. Other types of neural networks may be used as well. Indeed, for the fixed length stop description (FLSD) aspect of the present invention, a neural network is not necessarily required at all.

Nevertheless, a perceptton is a feed-forward network with no hidden units; the network only has an input layer that is directly connected to the output layer. The output layer for this embodiment of the invention thus has only one node. The value of the output node after the network has processed the inputs is the estimate of RRT for a particular car for a particular hall call for that state of the building. The disclosed training algorithm is, but need not be, a variant of the back propagation algorithm where a linear activation function is used for the output node. The linear activation function was used in this instance because it produces good results and also simplifies the training process for a network in an actual system. When using non-linear activation functions (e.g., sigmoid functions) the network does not always converge to a fixed set of weights. In such situations the performance of the network can vary drastically. In order to use such a network, a complex testing procedure would need to be developed to control the quality of the learned network. By using a linear activation function, those problems are avoided because the weights always converge the best solution meeting the training criteria. Nevertheless, it should be understood that the invention is not restricted to use of a linear activation function.

Figure 4:
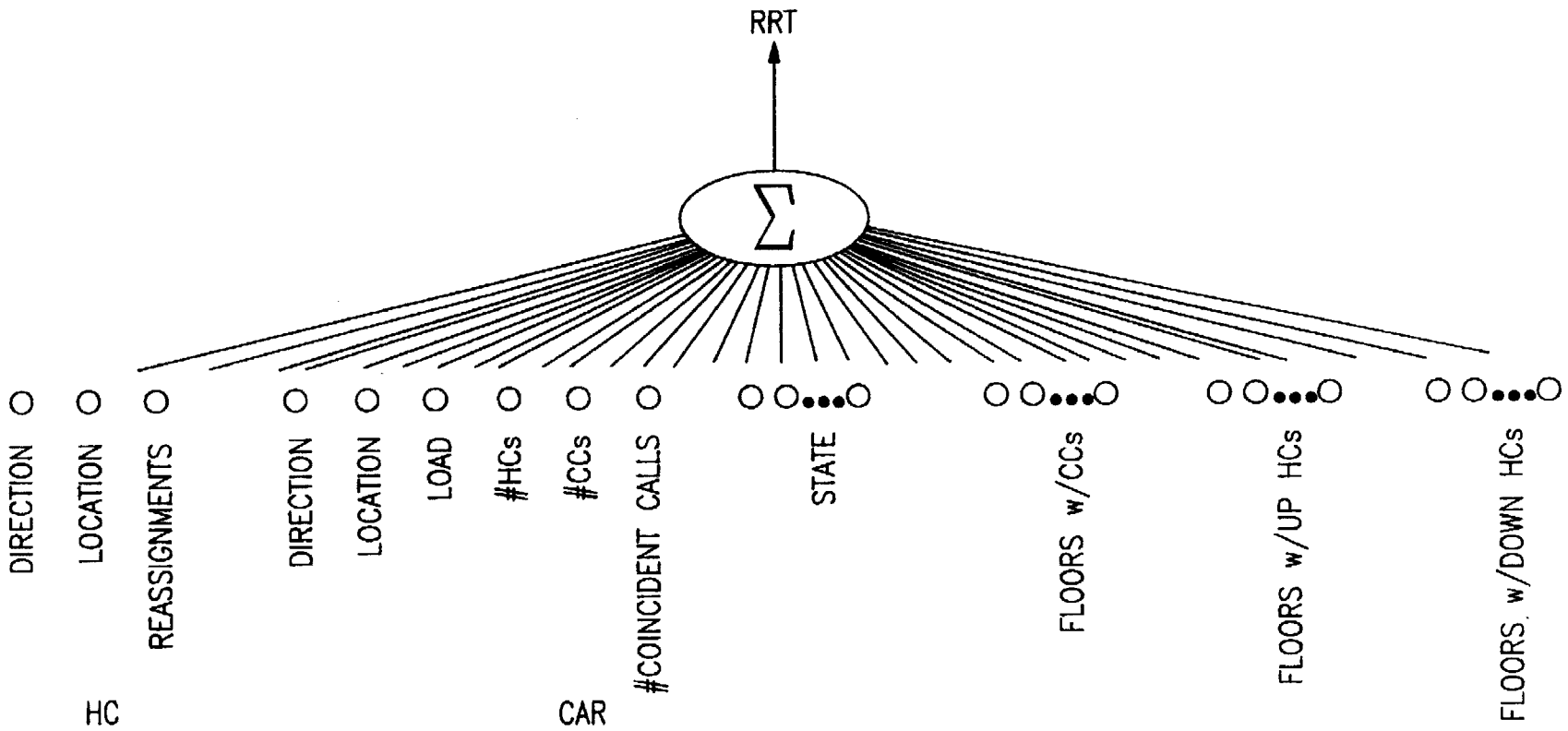
FIG. 4 shows an exemplary ANN in the form of a perception used for estimating RRT, based on selected elevator inputs, according to the present invention.

As an example, according to the present invention, the input nodes to an ANN for estimating RRT for a building with eighteen floors and six cars could be the following, as illustrated in FIG. 4:

TABLE 1

| Input Node | Description |
|---|---|
| 1) Hall-call-direction | Direction of requested service. |
| 2) Hall-call-floor-1 | Hall call requested from floor 1. |
| 3) Hall-call-floor-2 | Hall call requested from floor 2. |
| 4) Hall-call-floor-3 | Hall call requested from floor 3. |
| 5) Hall-call-floor-4 | Hall call requested from floor 4. |
| 6) Hall-call-floor-5 | Hall call requested from floor 5. |
| 7) Hall-call-floor-6 | Hall call requested from floor 6. |
| 8) Hall-call-floor-7 | Hall call requested from floor 7. |
| 9) Hall-call-floor-8 | Hall call requested from floor 8. |
| 10) Hall-call-floor-9 | Hall call requested from floor 9. |
| 11) Hall-call-floor-10 | Hall call requested from floor 10. |
| 12) Hall-call-floor-11 | Hall call requested from floor 11. |
| 13) Hall-call-floor-12 | Hall call requested from floor 12. |
| 14) Hall-call-floor-13 | Hall call requested from floor 13. |
| 15) Hall-call-floor-14 | Hall call requested from floor 14. |
| 16) Hall-call-floor-15 | Hall call requested from floor 15. |
| 17) Hall-call-floor-16 | Hall call requested from floor 16. |
| 18) Hall-call-floor-17 | Hall call requested from floor 17. |
| 19) Hall-call-floor-18 | Hall call requested from floor 18. |
| 20) Responding-car-direction | Direction of travel for car. |
| 21) Responding-car-floor-1 | Position of responding car is floor 1. |
| 22) Responding-car-floor-2 | Position of responding car is floor 2. |
| 23) Responding-car-floor-3 | Position of responding car is floor 3. |
| 24) Responding-car-floor-4 | Position of responding car is floor 4. |
| 25) Responding-car-floor-5 | Position of responding car is floor 5. |

TABLE 1-continued

| Input Node | Description |
|---|---|
| 26) Responding-car-floor-6 | Position of responding car is floor 6. |
| 27) Responding-car-floor-7 | Position of responding car is floor 7. |
| 28) Responding-car-floor-8 | Position of responding car is floor 8. |
| 29) Responding-car-floor-9 | Position of responding car is floor 9. |
| 30) Responding-car-floor-10 | Position of responding car is floor 10. |
| 31) Responding-car-floor-11 | Position of responding car is floor 11. |
| 32) Responding-car-floor-12 | Position of responding car is floor 12. |
| 33) Responding-car-floor-13 | Position of responding car is floor 13. |
| 34) Responding-car-floor-14 | Position of responding car is floor 14. |
| 35) Rbsponding-car-floor-15 | Position of responding car is floor 15. |
| 36) Responding-car-floor-16 | Position of responding car is floor 16. |
| 37) Responding-car-floor-17 | Position of responding car is floor 17. |
| 38) Responding-car-floor-18 | Position of responding car is floor 18. |
| 39) Current RRT Estimate | The current RRT estimate. |
| 40) Hall-call-switches | Number of times hall call was switched. |
| 41) Car-passengers | Number of passengers on car. |
| 42) Inter-hall-calls | Number of intervening hall calls. |
| 43) Inter-car-calls | Number of intervening car calls. |
| 44) Inter-coincident | Number of intervening coincident hall/car calls. |
| 45) Car-State-0[1] | Is car X in state 0? |
| 46) Car-State-1 | Is car X in state 1? |
| 47) Car-State-2 | Is car X in state 2? |
| 48) Car-State-3 | Is car X in state 3? |
| 49) Car-State-4 | Is car X in state 4? |
| 50) Car-State-5 | Is car X in state 5? |
| 51) Car-State-6 | Is car X in state 6? |
| 52) Car-State-7 | Is car X in state 7? |
| 53) Car-State-8 | Is car X in state 8? |
| 54) Car-State-9 | Is car X in state 9? |
| 55) Car-State-10 | Is car X in state 10? |
| 56) Car-State-11 | Is car X in state 11? |
| 57) Car-State-12 | Is car X in state 12? |
| 58) Car-State-13 | Is car X in state 13? |
| 59) Car-State-14 | Is car X in state 14? |
| 60) Direction-car-1 | Direction of travel for car 1. |
| 61) Position-car-1 | Position of Car 1. |
| 62) Direction-car-2 | Direction of travel for car 2. |
| 63) Position-car-2 | Position of Car 2. |
| 64) Direction-car-3 | Direction of travel for car 3. |
| 65) Position-car-3 | Position of Car 3. |
| 66) Direction-car-4 | Direction of travel for car 4. |
| 67) Position-car-4 | Position of Car 4. |
| 68) Direction-car-5 | Direction of travel for car 5. |
| 69) Position-car-5 | Position of Car 5. |
| 70) Direction-car-6 | Direction of travel for car 6. |
| 71) Position-car-6 | Position of Car 6. |
| 72) Up-hall-call-floor-1 | Car number of car assigned to up hall call at floor 1. |
| 73) Up-hall-call-floor-2 | Car number of car assigned to up hall call at floor 2. |
| 74) Up-hall-call-floor-3 | Car number of car assigned to up hall call at floor 3. |
| 75) Up-hall-call-floor-4 | Car number of car assigned to up hall call at floor 4. |
| 76) Up-hall-call-floor-5 | Car number of car assigned to up hall call at floor 5. |
| 77) Up-hall-call-floor-6 | Car number of car assigned to up hall call at floor 6. |
| 78) Up-hall-call-floor-7 | Car number of car assigned to up hall call at floor 7. |
| 79) Up-hall-call-floor-8 | Car number of car assigned to up hall call at floor 8. |
| 80) Up-hall-call-floor-9 | Car number of car assigned to up hall call at floor 9. |
| 81) Up-hall-call-floor-10 | Car number of car. assigned to up hall call at floor 10. |
| 82) Up-hall-call-floor-11 | Car number of car assigned to up hall call at floor 11. |
| 83) Up-hall-call-floor-12 | Car number of car assigned to up hall call at floor 12. |
| 84) Up-hall-call-floor-13 | Car number of car assigned to up hall call at floor 13. |
| 85) Up-hall-call-floor-14 | Car number of car assigned to up hall call at floor 14. |
| 86) Up-hall-call-floor-15 | Car number of car assigned to up hall call at floor 15. |

TABLE 1-continued

| Input Node | Description |
|---|---|
| 87) Up-hall-call-floor-16 | Car number of car assigned to up hall call at floor 16. |
| 88) Up-hall-call-floor-17 | Car number of car assigned to up hall call at floor 17. |
| 89) Reserved | To be determined later. |
| 90) Reserved | To be determined later. |
| 91) Down-hall-call-floor-2 | Car number of car assigned to down hall call at floor 2. |
| 92) Down-hall-call-floor-3 | Car number of car assigned to down hall call at floor 3. |
| 93) Down-hall-call-floor-4 | car number of car assigned to down hall call at floor 4. |
| 94) Down-hall-call-floor-5 | Car number of car assigned to down hall call at floor 5. |
| 95) Down-hall-call-floor-6 | Car number of car assigned to down hall call at floor 6. |
| 96) Down-hall-call-floor-7 | Car number of car assigned to down hall call at floor 7. |
| 97) Down-hall-call-floor-8 | Car number of car assigned to down hall call at floor 8. |
| 98) Down-hall-call-floor-9 | Car number of car assigned to down hall call at floor 9. |
| 99) Down-hall-call-floor-10 | Car number of car assigned to down hall call at floor 10. |
| 100) Down-hall-call-floor-11 | Car number of car assigned to down hall call at floor 11. |
| 101) Down-hall-call-floor-12 | Car number of car assigned to down hall call at floor 12. |
| 102) Down-hall-call-floor-13 | Car number of car assigned to down hall call at floor 13. |
| 103) Down-hall-call-floor-14 | Car number of car assigned to down hall call at floor 14. |
| 104) Down-hall-call-floor-15 | Car number of car assigned to down hall call at floor 15. |
| 105) Down-hall-call-floor-16 | Car number of car assigned to down hall call at floor 16. |
| 106) Down-hall-call-floor-17 | Car number of car assigned to down hall call at floor 17. |
| 107) Down-hall-call-floor-18 | Car number of car assigned to down hall call at floor 18. |

Figure 5:
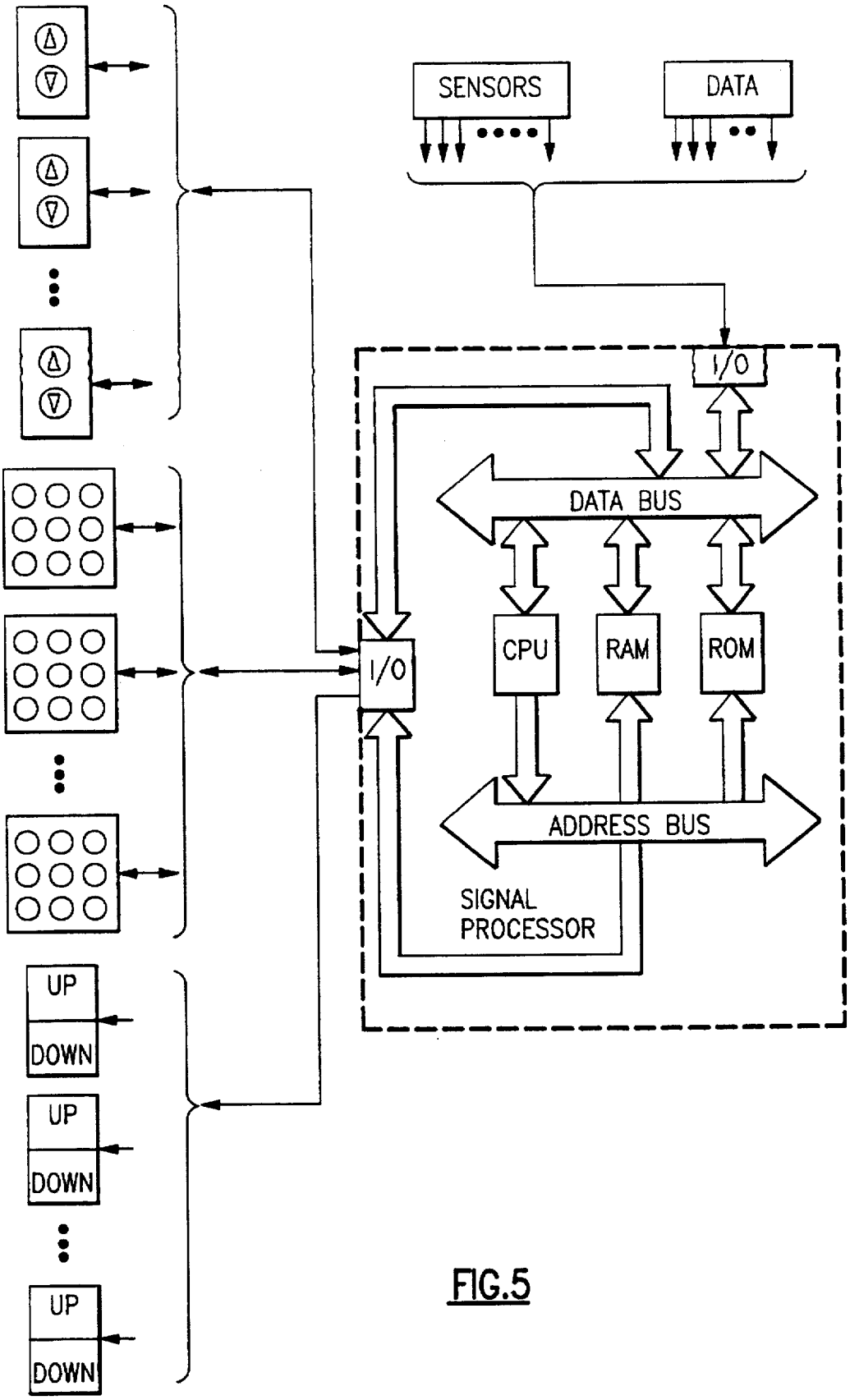
FIG. 5 shows an elevator system having a signal processor responsive to various input signals for estimating remaining response time using the neural network procedures of the present invention.

[1]Exactly one of the Car State inputs is set to 1, all the rest are 0. The states are as follows (three extra states are shown in this case but are unused):
0 - Parked, motor generator set off
1 - Parked, Motor generator set on
2 - Stopped, boarding up passengers, doors ready to close
3 - Stopped, boarding down passengers, doors ready to close
4 - Stopped, not boarding passengers, doors ready to close
5 - Stopped, boarding up passengers, door open time not expired
6 - Stopped, boarding down passengers, door open time not expired
7 - Stopped, not boarding passengers, door open time not expired
8 - Moving up, committed to stop
9 - Moving down, committed to stop
10 - Moving up, uncommitted
11 - Moving down, uncommitted The inputs listed above would be provided to a signal processor such as shown in FIG. 5 used in or as an elevator dispatching controller. Such a signal processor is responsive to a plurality of sensors and data signals provided at an I/O port thereof. Similarly, another input/output port is illustrated as being connected to a plurality of hall call pushbuttons resident on the various floors of the building, a plurality of car call pushbutton panels, one resident in each car, and hooked up to a plurality of hall lanterns, typically one or more for each floor. The signal processor itself includes a data bus, an address bus, a central processing unit (CPU), a random access memory (RAM) and a read only memory (ROM) for storing sequential steps that can carry out the training and implementation of a neural network such as shown in FIGS. 1 and 4, according to the present invention.

Figure 6:
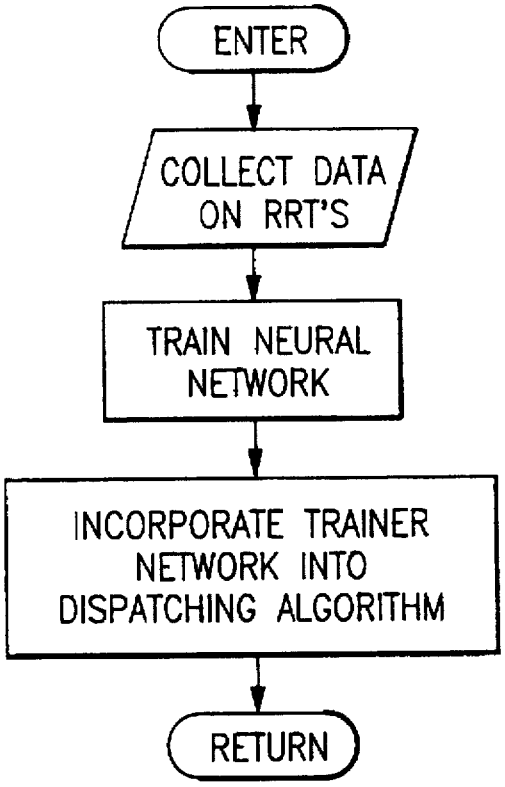
FIG. 6 shows a series of steps which may be carried out by the processor of FIG. 5 in establishing a neural network and incorporating such a network into an overall dispatching scheme, according to the present invention.
Figure 23:
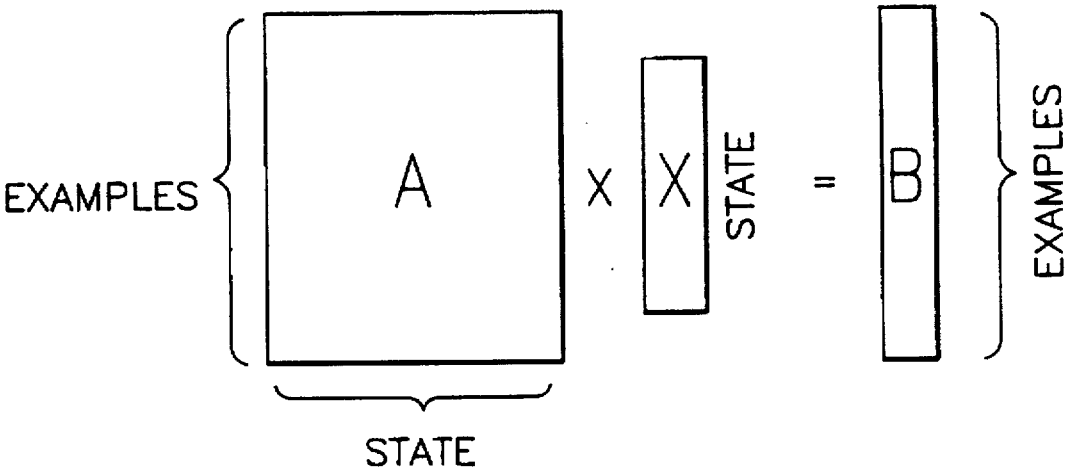
FIG. 23 shows an example of a procedure for actual use of a neural network, for example after training, according to the present invention.

The training phase of such a neural network, as carried out by the signal processor of FIG. 5, is illustrated in the flow chart of FIG. 6. After entering, data is collected for various actual remaining response times for a plurality of hall calls and assigned cars. In addition to collecting the actual response times, the state of the building for the particular car and hall call is saved at the moment of assignment in order to enable the construction of the neural network with a large number of such RRTs combined with "snapshots" of the state of the building at the time of assignment for each such RRT. After collection of the RRTs and associated "snapshots" of the building, the neural network is trained, as shown in FIG. 6, in a next step. After training of the neural network the trained network is incorporated into a dispatching algorithm which may also be resident in the signal processor of FIG. 5 and which is further illustrated by the car assignment module of FIG. 2. The data collection and training steps described in connection with FIG. 6 will be described in more detail below after the filtering concept of the second aspect of the present invention, i.e., the fixed length stop description, is disclosed below.

A number of experiments were conducted with the above inputs using the approach of this invention. The system is able to perform much better than the current RRT estimation approach such as shown in U.S. Pat. No. 5,146,053. For the experiment, in a typical building during noon-time traffic, the average absolute error in estimating RRT using the current approach is 11.15 seconds. With the ANN for RRT, according to the present invention, under the same conditions, the average absolute error in estimating RRT is 6.79 seconds.

As will be observed, the above list includes a very large number of inputs which is peculiar to only one building. In other words, if it were desired to use another ANN for another building, the number of inputs would change because of the different number of floors and the different number of cars. This creates a difficult and unwieldy situation for trying to design an ANN or any other downstream module that can be transported from building to building without having to change the number of inputs thereto.

Fixed Length Stop Description (FLSD)

The second aspect of the present invention provides a method of describing the current state of the building as observed from the perspective of a specific elevator car with respect to a particular plan of behavior, in a canonical form that is independent of the size of the building and number of cars in the group. The above described method of FIG. 4 produced a set of vectors for each car in the group. Each car has a vector for the assigned hall calls and another vector for the registered car calls. A hall call, of course, occurs when someone presses the button to request elevator service. Similarly, the user of an elevator registers a car call when a button is pressed inside the car to indicate the desired destination. The size of each vector is roughly twice the number of floors in the building. (Half the vector is used for upward calls and half for downward calls.) A system wanting to use information about car calls and hall calls must handle all of the vectors for a particular set of cars (two vectors per car). When a dispatching system is installed in different buildings, modifications must be made to account for the different number of vectors and the different vector lengths. Considering the training process required for ANNs, this makes it difficult to develop transportable ANNs for dispatching systems.

The Fixed Length Stop Description (FLSD) of the present invention acts as a filter between the vectors describing the stops of a building and systems using that information. An application of such an FLSD is the ANN for RRT estimation described previously. It would be highly impractical to redesign the ANN for each building if the raw vectors for the particular building were used as input. In addition, the training time would change, based on the building. Instead, the vectors are converted into a Fixed Length Stop Description (FLSD) that eliminates the need to change the ANN for RRT estimation between buildings.

To use the Fixed Length Stop Description, the data for each of the floors of the building that are relevant to the current elevator car RRT problem is passed to an FLSD filter. In the ANN for RRT situation, the relevant floors are those on a selected path from the current elevator car position to the outstanding hall call to be serviced. Various paths can be used with the filter, e.g., best and worst case scenarios. All paths, selected paths, or a midpoint or average path could be selected as well. For each path considered for a car, the filter constructs or compiles a three by three table as shown, for example, in FIG. 8. One dimension of the table represents car calls and the other dimension represents hall calls, for example. It should be understood that the table can take on other dimensions to include more or less information. For the example, the indices in each dimension are then labeled as None, ThisCar, and OtherCars. The None index is used when no car has a request for the floor under consideration for the current dimension. ThisCar is used when the current car being considered for the new assignment has a service request for the floor. OtherCars indicates that the current car does not have a request at that floor but at least one other car does have a service request for the floor. Each element of the table is a count of the number of floors meeting its index requirements. For example, the table element with the hall call dimension set to ThisCar and car call dimension set to OtherCars holds a count of the number of floors where the current car must stop to service an assigned hall call and other cars must stop at the (same) floor to drop off current passengers. The filter may process each floor individually. Using the provided vectors, the filter determines which entries of the table should be incremented and thereby compiles the table. Since exactly one entry is incremented for each floor in each direction the total of all the entries always equals the length of the path.

After the path is fully characterized, the filter provides the nine entries of the table as outputs. Regardless of the vector size, number of vectors, and path provided, only nine entries are needed to capture many interesting aspects of the stops. The table entries indicate how many stops of the car under consideration for an assignment are coincident with no other cars, any other car, or itself. The table indicates how many floors are not currently scheduled to be serviced by any car or only for hall calls or car calls. This summarized information provides previously used information in a new condensed format and additionally provides new information that was not readily apparent previously.

When the Fixed Length Stop Description is used in conjunction with a downstream module such as but not limited to an RRT Module (such as the above-described ANN for RRT), the downstream module can be made to accept a fixed number of inputs, regardless of the building, and previously disorganized input elements representing the states of various floors are replaced with the entries from the tables as shown, for example, by the following in which the abbreviation HC is used for Hall Call and CC is used for Car Call:

TABLE 2

| ANN Inputs | Description |
|---|---|
| 1) Passengers | The number of passengers currently in car X. |
| 2) Passengers-per-CC | Input #1) divided by the current number of Car Calls. |
| 3) Current RRT Estimate | The current RRT estimate. |
| 4) Committed-Stops | The number of times car X is committed to stop. |
| 5) Turnarounds | The number of times car X must change direction before reaching the call in the correct direction. |
| 6) Maximum[2]-Path-Length | The total number of floors passed if car X followed the Maximum Path (including express zone floors). If the same floor is passed more than once it is counted each time. This input is more a measure of distance than a count of possible stops. |
| 7) Maximum-Lobby-Stops | The number of stops in Input #6) which are at lobby floors. |
| 8) Maximum-Express-Zone-Count | The number of floors in Input #6) which are within the express zone. |
| 9) Maximum-Stops-Type-1 | The number of non-express zone stops in Input #6) for which no car has a HC or CC. |
| 10) Maximum-Stops-Type-2 | The number of stops in Input #6) for which X has a CC, and no car has a HC. |
| 11) Maximum-Stops-Type-3 | The number of stops in Input #6) for which car X has no CC, but some other car has a CC, and no HC has been assigned. |
| 12) Maximum-Stops-Type-4 | The number of stops in Input #6) for which car X has a HC, but no car has a CC. |
| 13) Maximum-Stops-Type-5 | The number of stops in Input #6) for which car X has both a HC and CC. |
| 14) Maximum-Stops-Type-6 | The number of stops in Input #6) for which car X has a HC, no CC, and some other car has a CC. |
| 15) Maximum-Stops-Type-7 | The number of stops in Input #6) for which some other car has a HC, and no cars have CC's. |
| 16) Maximum-Stops-Type-8 | The number of stops in Input #6) for which car X has a CC, and some other car has a HC. |
| 17) Maximum-Stops-Type-9 | The number of stops in Input #6) for which car X has no HC or CC, but some other car has a CC and a HC has been assigned to some car. |
| 18) Minimum[3]-Path-Length | The total number of floors passed if the car followed the Minimum Path (including express zone stops). If the same floor is passed more than once it is counted each time. This input is more a measure of distance than a count of possible stops. |
| 19) Minimum-Lobby-Stops | The number of stops in Input #18) which are at lobby floors. |

TABLE 2-continued

| ANN Inputs | Description |
|---|---|
| 20) Minimum-Express-Zone-Count | The number of stops in Input Count #18) which are within the express zone. |
| 21) Minimum-Stops-Type-1 | The number of non-express zone stops in Input #18) for which no car has a HC or CC. |
| 22) Minimum-Stops-Type-2 | The number of stops in Input #18) for which car X has a CC, and no car has a HC. |
| 23) Minimum-Stops-Type-3 | The number of stops in Input #18) for which car X has no CC, but some other car has a CC, and no HC has been assigned. |
| 24) Minimum-Stops-Type-4 | The number of stops in Input #18) for which car X has a HC, but no car has a CC. |
| 25) Minimum-Stops-Type-5 | The number of stops in Input #18) for which car X has both a HC and CC. |
| 26) Minimum-Stops-Type-6 | The number of stops in Input #18) for which car X has a HC, no CC, and some other car has a CC. |
| 27) Minimum-Stops-Type-7 | The number of stops in Input #18) for which some other car has a HC, and no cars have CC's. |
| 28) Minimum-Stops-Type-8 | The number of stops in input #18) for which car X has a CC, and some other car has a HC. |
| 29) Minimum-Stops-Type-9 | The number of stops in Input #18) for which car X has no HC or CC, but some other car has a CC and a HC has been assigned to some car. |
| 30) Car-State-0[4] | Is car X in state 0? |
| 31) Car-State-1 | Is car X in state 1? |
| 32) Car-State-2 | Is car X in state 2? |
| 33) Car-State-3 | Is car X in state 3? |
| 34) Car-State-4 | Is car X in state 4? |
| 35) Car-State-5 | Is car X in state 5? |
| 36) Car-State-6 | Is car X in state 6? |
| 37) Car-State-7 | Is car X in state 7? |
| 38) Car-State-8 | Is car X in state 8? |
| 39) Car-State-9 | Is car X in state 9? |
| 40) Car-State-10 | Is car X in state 10? |
| 41) Car-State-11 | Is car X in state 11? |
| 42) Car-State-12 | Is car X in state 12? |
| 43) Car-State-13 | Is car X in state 13? |
| 44) Car-State-14 | Is car X in state 14? |

[2] The Maximum Path (FIGS. 16–20) is calculated by following the current motion of the car until the call is reached, only allowing turnarounds at the top and bottom of the building. The car arrives at the call only when it is at the same floor, moving in the call's direction of travel. Travel past the top or bottom floors only count as one possible stop along the path. Inputs #8) through #17) always sum to equal Input #6).

[3] The Minimum Path (FIGS. 16–20) is similar to the Maximum Path except that turnarounds are permitted as soon as commitments in the current direction have been satisfied. Hall call's are assumed to have only a single destination - exactly one floor away from the call. The Minimum Path can never be longer than the Maximum Path. Inputs #20) through #29) always sum to equal Input #18).

[4] Exactly one of the Car State inputs is set to 1, all the rest are 0.

Figure 8:
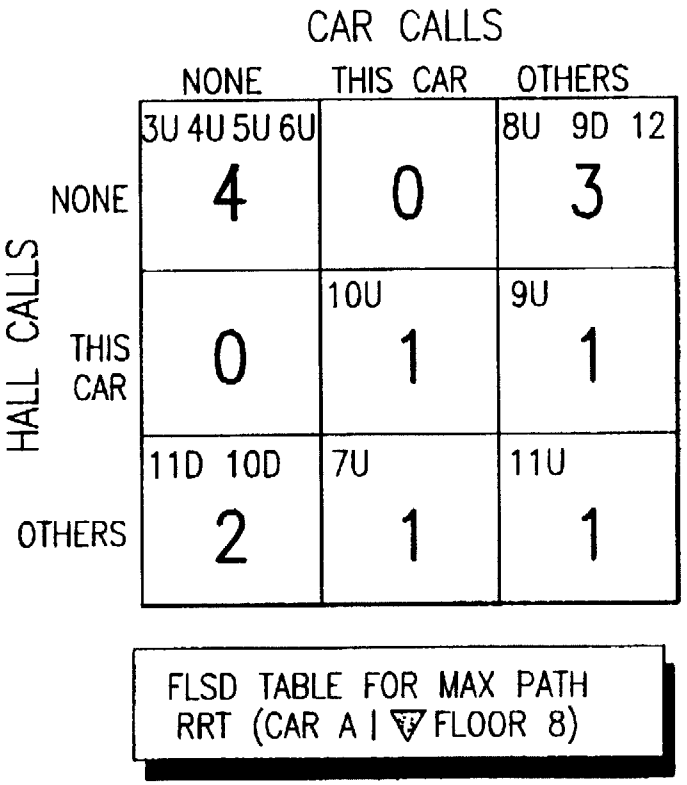
FIG. 8 illustrates a fixed length stop description technique, according to the present invention for characterizing the degree to which an elevator car will experience delays in travelling toward an assigned hall call in a format that is independent of the building and the number of cars in the group.
Figure 9:
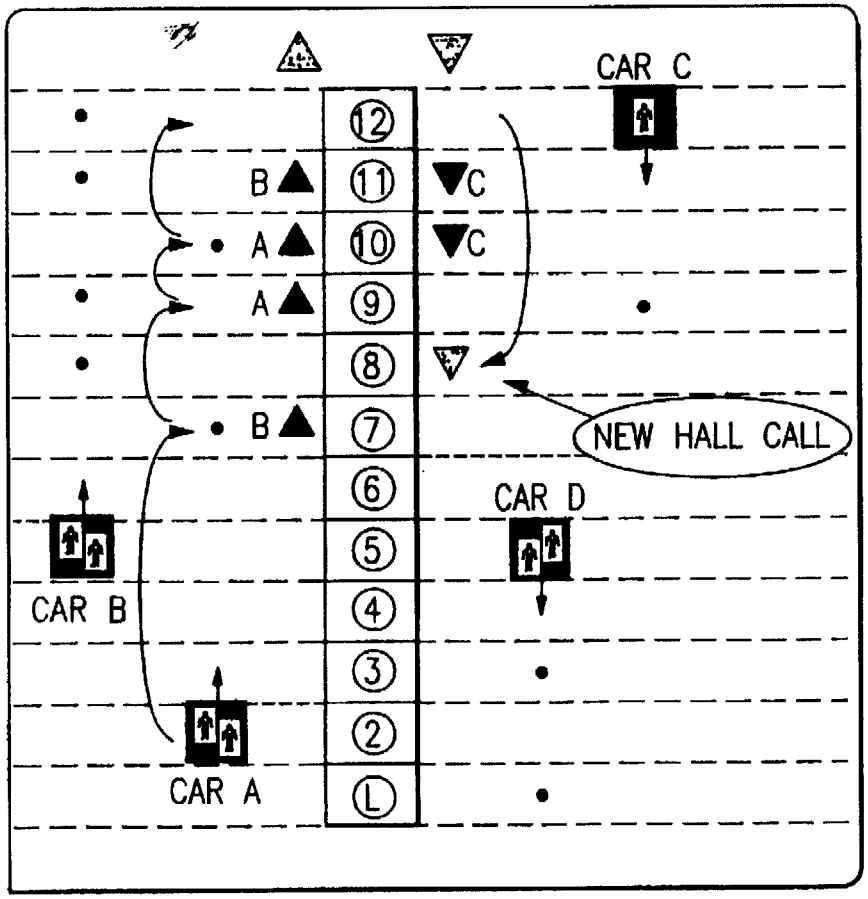
FIG. 9 shows an example of the use of the FLSD table of FIG. 8 for an exemplary maximum path length that a car might experience in answering a new hall call.
Figure 10:
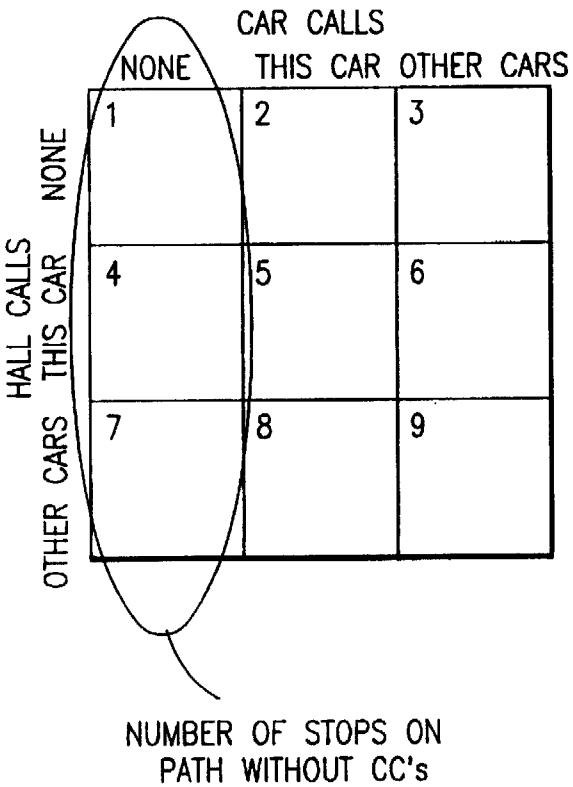

FIG. 9 shows a new down hall call registered at landing 8 of a twelve floor building in which four cars service both hall calls and car calls. In the illustration, which is further illustrated by FIG. 8, car A is considered for a maximum path length to service the new hall call; it has to travel from floor 2 upward in the hoistway to floor 12, turnaround and go down the hoistway to floor 8. On this maximum path that is illustrated in FIGS. 8 and 9, in the same direction, the total number of stops on the path not having car calls associated therewith is illustrated compiled in the leftmost column of FIG. 8, as shown in FIG. 10. These include 3 up, 4 up, 5 up, 6 up, 11 down and 10 down, as shown inside the upper lefthand box and the lower lefthand box of the FLSD table of FIG. 8. Thus there are a total of 6 stops on the maximum path of FIG. 9 for car A without car calls.

Similarly, the center column of the FLSD table of FIG. 8 illustrates the total number of car calls for car A, i.e., 2 (10 up and 7 up). It is noted that the 10 up car call for car A is compiled in the center box of the FLSD table while the 7 up car call for car A is compiled in the bottom box of the center column. These are compiled in the manner illustrated to differentiate the fact that although both stops have a hall call and a car call associated therewith, the designation of coincident hall call is only applied to 10 up. That is, with respect to car A, only 10 up is considered to be a coincidental hall/car call floor.

Figure 12:
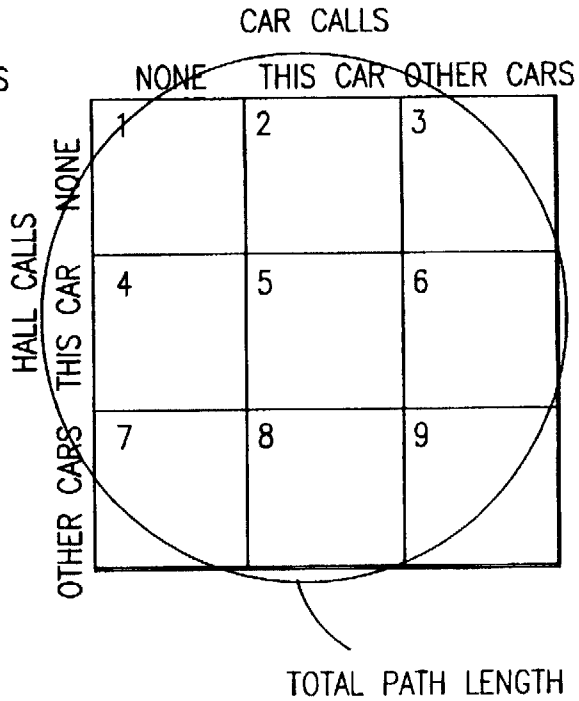
FIGS. 10–15 illustrate how the table of FIG. 10 can be used to characterize information about car calls and hall calls for a particular car in answering a newly registered hall call in relation to a particular set of cars in a particular building.
Figure 11:
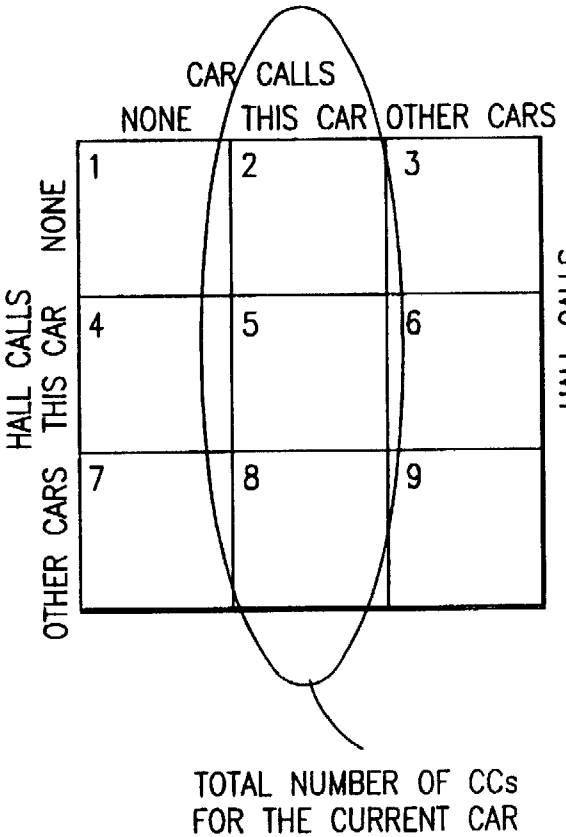

FIG. 12 shows how the FLSD table of FIG. 8 may be used to calculate the total path length for car A in FIG. 9 in traversing the maximum path, i.e., by simply adding up all of the numbers in the box to get a total path length of 13 floors to reach the new hall call.

Figure 13:
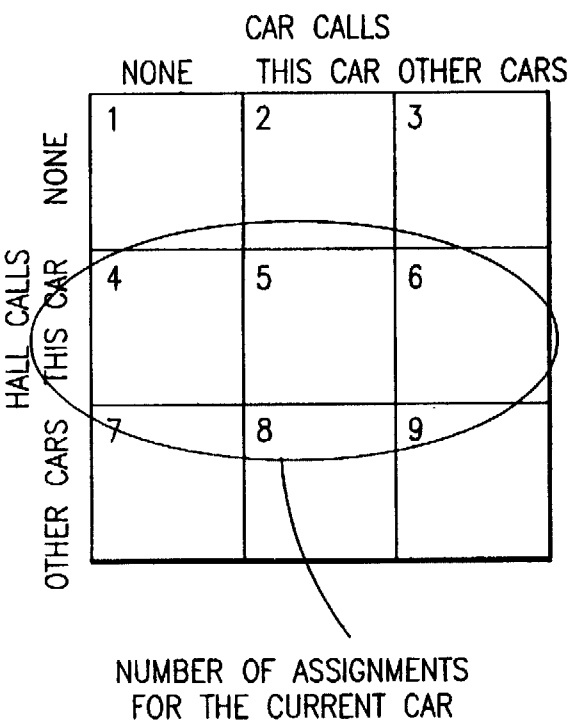

FIG. 13 shows how the FLSD table of FIG. 8 can be used to determine the number of hall call assignments for the current car. In the illustration of FIG. 8, car A has 2 hall calls assigned to it, i.e., 9 and 10 up. Although they are associated with car calls, the car calls are registered in different cars, as may be clearly seen from the table.

Figure 14:
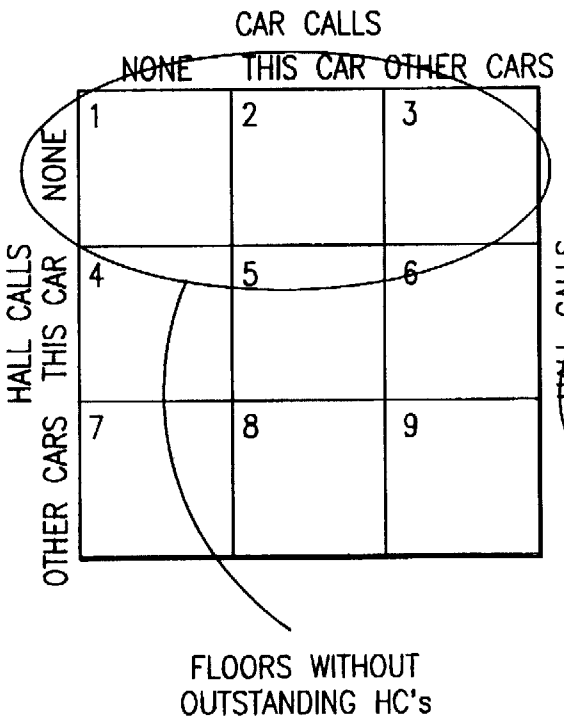

FIG. 14 shows that the number of floors without outstanding hall calls can be easily determined from the top row of the FLSD table. For example, FIG. 9 shows that there are no hall calls at floors 3 up through 6 up along the path of car A and reaching the new hall call and no outstanding hall calls at floors 8 up, 12 and 9 down along the same maximum path, for a total of 7 floors without outstanding hall calls.

Figure 15:
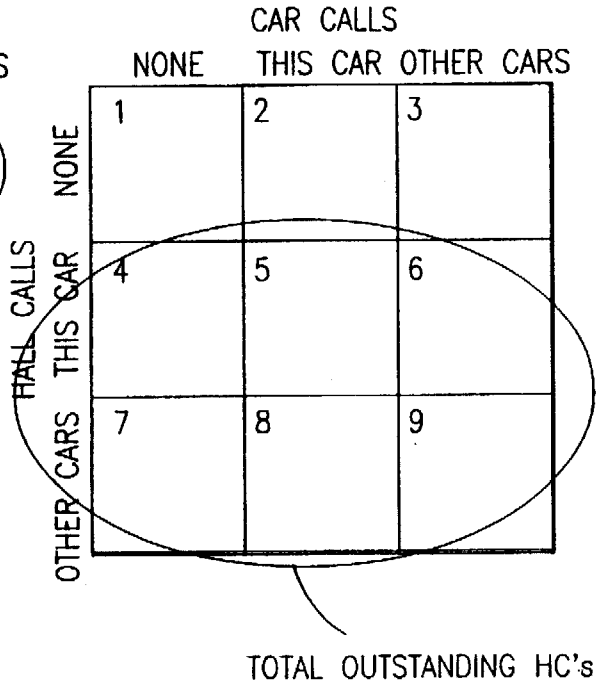

FIG. 15 shows that the total number of outstanding hall calls along the path of car A and reaching the new hall call is 6, i.e., 7 up, 9–11 up, 11 down and 10 down.

It will thus be seen that the FLSD table compiled as in FIG. 8 is a convenient way to summarize the condition of the building associated with any particular selected path of a specific car.

FIGS. 16–20 illustrate various examples of minimum and maximum path lengths for answering a registered but unassigned hall call (unshaded triangle). Some of the examples include already registered car calls (shaded circles) and assigned hall calls (shaded triangles) along the path under consideration. FIG. 16 shows a case where a hall call at floor 12 can be answered by a car with no commitments rather directly so that the minimum and maximum paths may coincide. FIG. 17 shows a case where an up hall call at floor 10 is already assigned to a car on its way up and being considered for answering a newly registered down hall call at floor 12. After answering the up hall call at floor 10, a maximum path would entail going to the top of the building at floor 15, turning around and heading down the hoistway to floor 12. A minimum path would involve discharging a passenger at floor 11 or 12 and servicing the downwardly intending passenger at floor 12.

FIG. 18 shows a case where an assigned up hall call is two floors above a newly registered down hall call at floor 8. In that case, a minimum path length would involve going up at least one floor to floor 11, reversing direction and heading down several floors to floor 8. A maximum path would involve going all the way up to the top of the building, reversing direction and going down almost half the length of the building to service the down hall call at floor 8.

FIG. 19 shows still another example, where a car call within the car under consideration is two floors above the newly registered down hall call at floor 8. It is similar to the case of FIG. 18 except the minimum path is definitely one floor less since there is no possibility of having to go up one floor.

FIG. 20 shows a case with two hall calls already assigned to the car under consideration, one up at floor 10 and one down at floor 12. In that case, a newly registered up hall call at floor 6 could result in a maximum path length of having to go from floor 7 where the car is presently located all the way up to the top of the building after servicing the up hall call at floor 10, reversing direction and stopping at floor 12 to service the assigned down hall call at that floor and then proceeding all the way to the lobby and back up again to floor 6 to service the newly registered up hall call at that floor. A minimum path for the same scenario would only involve going up one floor after servicing floor 10 and having the downwardly intending passenger at floor 12 getting off somewhere between floor 12 and floor 6 so as to avoid having to go down below floor 6.

These illustrations show best and worst case scenarios for individual newly registered hall calls under consideration for service by a given car. It should be realized, however, that the paths considered and used as the basis for the outputs of the table, i.e., worst and best case scenarios, need not be confined thereto. All possible paths could be considered. A middle path could be considered. An average path could equally well be considered. Thus it should be realized that any number of different paths could be considered by the FLSD table and, if applicable, the downstream neural network module.

Figure 21:
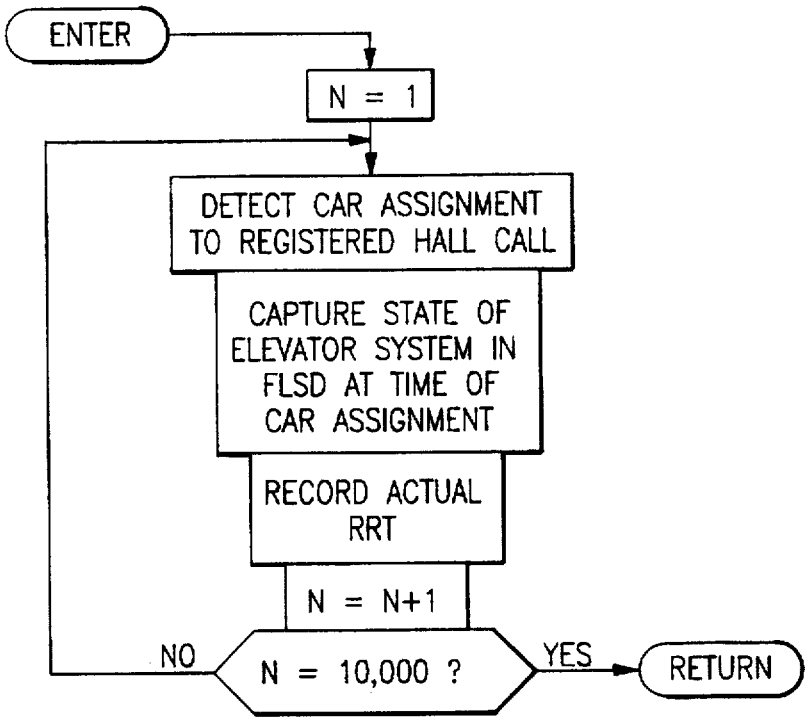
FIG. 21 shows the data collection step of FIG. 6 in accordance with the second aspect of the present invention.

Turning now to FIG. 21, the data collection step of FIG. 6 is illustrated in more detail. After entering, an index n is set equal to 1 and a repetitive loop is entered for constructing a data history for training the neural network in the training step of FIG. 6. This may involve many hundreds or even thousands of test cases so as to force the best weights for the connections between the inputs and the neural node of FIGS. 1 and 4.

The illustrated loop is merely an illustration and can of course be modified in any number of different ways that will be evident to those of skill in the art. The illustrated first step is to detect a car assignment to a registered hall call. The elevator system state is then captured in an FLSD table such as shown in FIG. 8 for that car for a particular path or plural paths. The actual time for the car to service the call after assignment is then measured and recorded along with the captured state of the elevator system at the time of assignment. The index n is then incremented and a determination made as to whether a desired number of samples has been reached or not. If not, the whole process is repeated until the desired number is reached.

Figure 22:
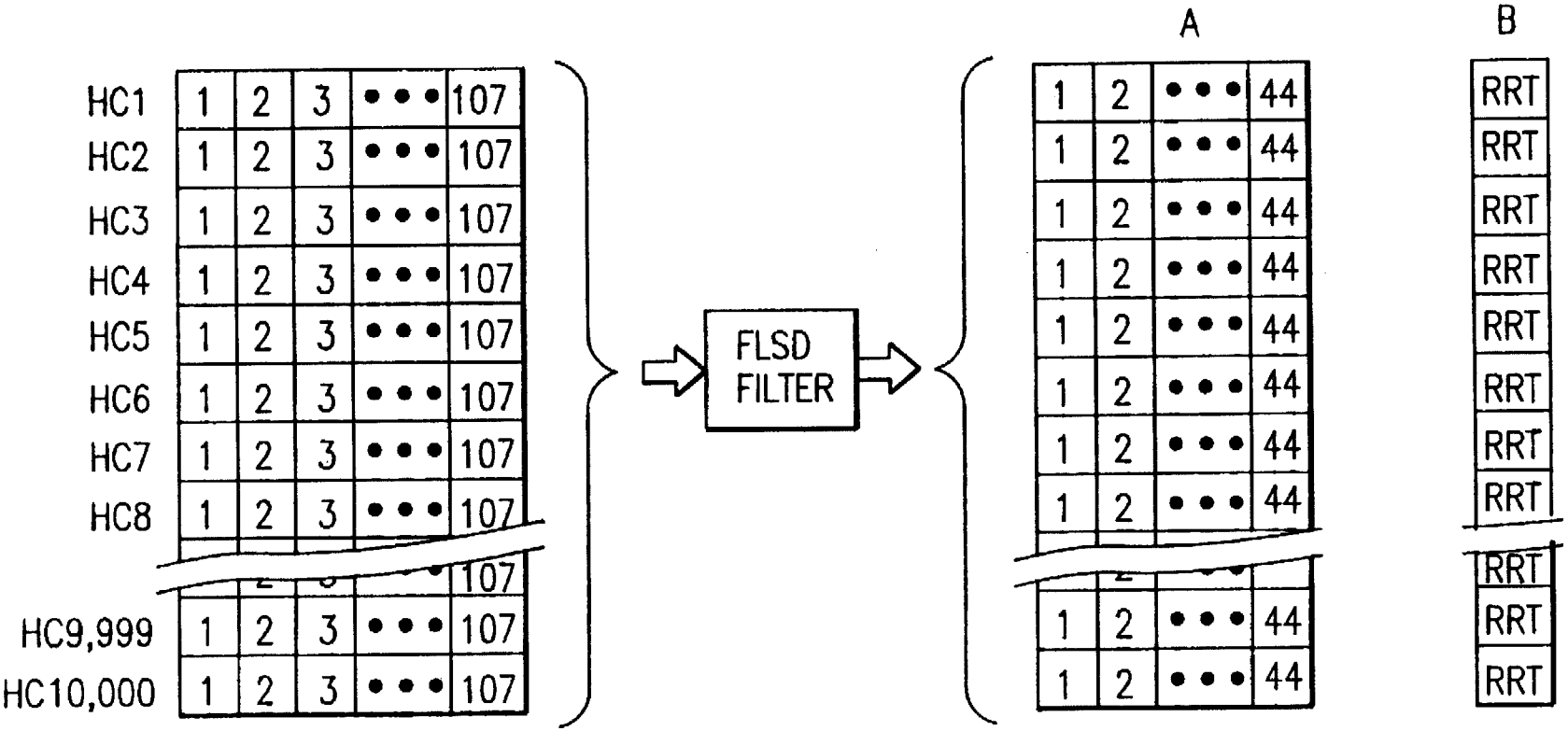
FIG. 22 shows an example of a filtering step of FIG. 21, i.e., used for training purposes, in accordance with the present invention.

FIG. 22 shows, on the lefthand side, 10,000 examples of registered hall calls being answered by particular cars, each of which had an associated captured elevator system state comprising 107 inputs associated therewith stored by the program of FIG. 21. These 107 inputs correspond to the 107 inputs already described in Table 1 for the example of an 18 floor building with 6 cars.

After collecting the data on the lefthand side of FIG. 22 by means of the program of FIG. 21, an FLSD filter such as shown in FIG. 8 is used to summarize the data (as in Table 2) in a way that can be used by a standardized downstream module such as a standardized artificial neural network (ANN) having a fixed number of inputs, as illustrated by the already described ANN with 44 inputs. This permits the same ANN or downstream module to be used in any building.

On the righthand side of FIG. 22 is shown a table labelled A that represents 10,000 FLSD tables corresponding to the 10,000 examples on the lefthand side reduced by means of the FLSD "filter" to 44 characterizations in each case instead of 107. Also shown is a single RRT column with one RRT for each of the 10,000 events and labelled B.

A least squares linear regression is then performed on the large set of examples shown by A and B of FIG. 22. Such a least squares linear regression is summarized mathematically by the matrix expression $$AX=B$$

A is the matrix of example states shown in FIG. 22 and B is the matrix of corresponding actual RRTs. By computing A inverse, and multiplying A inverse by B, we obtain the matrix X containing the weights for the neural network.

Figure 2:
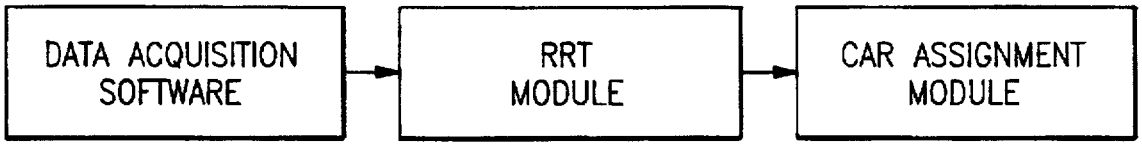
FIG.2 Prior Art
FIG. 2 shows a prior art remaining response time module in connection with a data acquisition module and a car assignment module.
Figure 3:
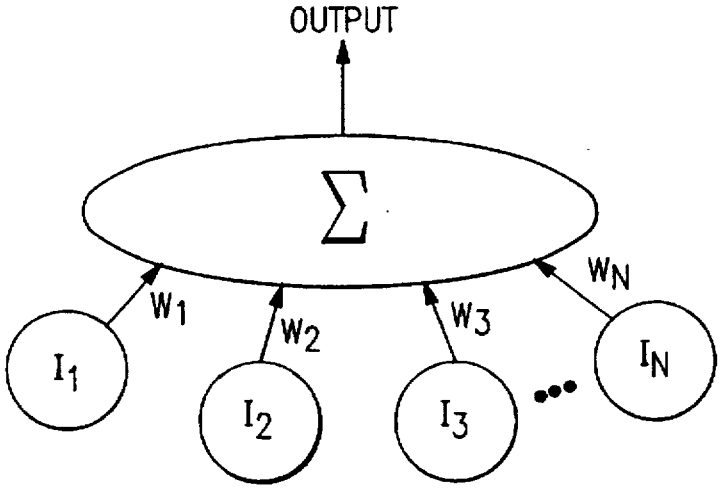
FIG.3 Prior Art
FIG. 3 shows a prior art perception such as may be used in the ANN for estimating RRT of FIG. 1.
Figure 24:
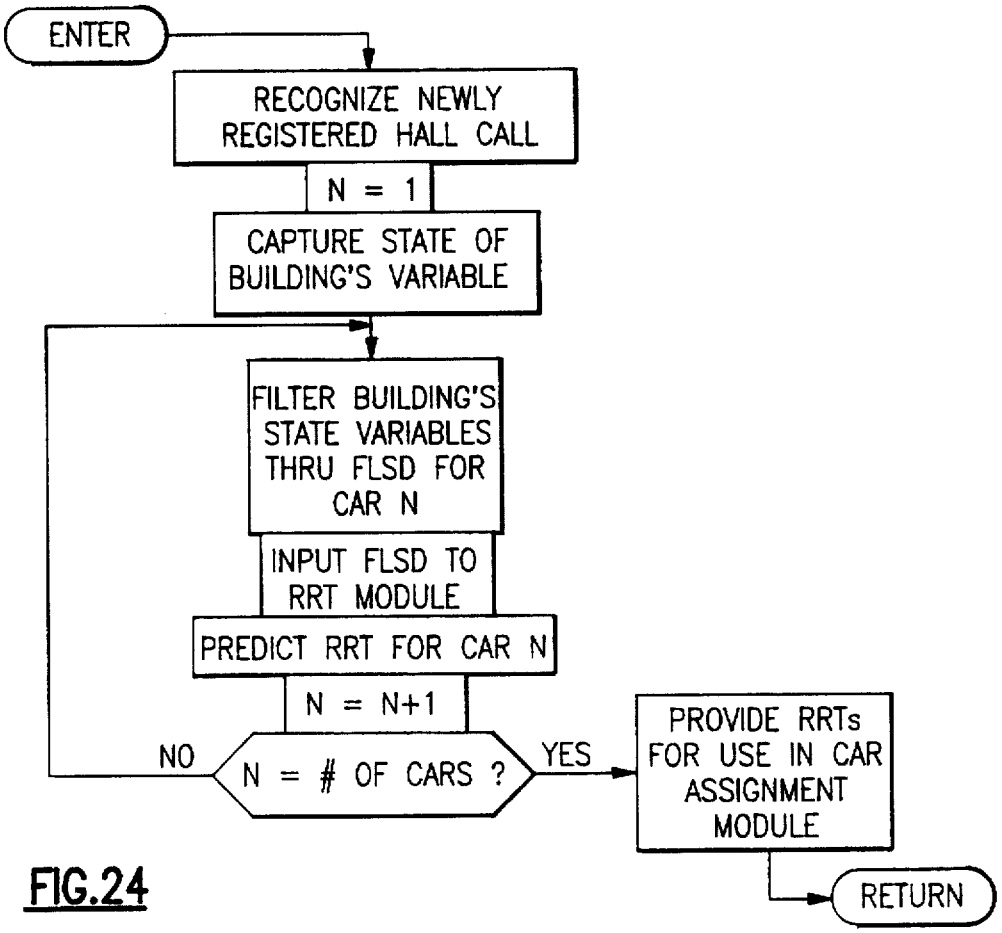
FIG. 24 shows according to the present invention how an FLSD for a particular car may be used by an ANN in an RRT module to provide an RRT for the car.

Once the weights for the neural network are determined in this way, each of the cars in the building can be evaluated in answering a new hall call as illustrated in FIG. 24 by recognizing a newly registered hall call and then capturing the state of the building's variables at that point in time. These state variables are filtered by an FLSD for each car in the building, as shown in FIG. 24 and, for example, an RRT predicted for each car in a downstream RRT module. The RRTs may then be used in a car assignment module such as shown in FIG. 2 in any desired manner.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. A method for use in an elevator control neural network for estimating a remaining response time for an elevator car in answering a hall call in a building, comprising the steps of:

providing fixed length stop description input signals representing filtered information relating to the elevator car and conditions in the building at a time of a registration of a hall call for an instant assignment, said fixed length stop description input signals being fixed in length regardless of the size of the building and the number of elevator cars therein;

weighting each of the fixed length stop description input signals with respective weighted signals preselected according to an iterative training scheme for a neural network, for providing respective weighted fixed length stop description input signals;

summing the respective weighted fixed length stop description input signals, for providing a remaining response time signal representing information relating to a remaining response time for the elevator car to answer the hall call in the building;

performing the preceding steps for a plurality of remaining elevator cars in the building, for providing a corresponding plurality of remaining response time signals; and assigning instantly a selected elevator car to answer the hall call in the building in response to the corresponding plurality of remaining response time signals.

2. A method of processing a number of input signals representing a state of a building having elevator cars, comprising the steps of:

providing from the number of the input signals a subset of input signals representing information relating to a corresponding subset of floors along a selected elevator car path in the building; and compiling a fixed length stop description table in response to the subset of input signals, for providing fixed length stop description table signals representing a filtered state of the building and that is fixed in length regardless of the size of the building and the number of elevator cars therein;

performing the preceding steps for a plurality of elevator cars in the building, for providing a corresponding plurality of remaining response time signals; and assigning a selected elevator car to answer the hall call in the building in response to the corresponding plurality of remaining response time signals.

3. A method according to claim 2, wherein said step of compiling comprises a step of compiling the input signals into the fixed length stop description table signals for storing in cells of said fixed length stop description table; and wherein the method further comprises a step of responding to said fixed length stop description table signals, for providing a remaining response time signal indicative of a remaining response time for an elevator car to answer the hall call in the building.

4. A method according to claim 3, wherein said step of responding comprises the steps of:

weighting each of the fixed length stop description table signals with respective weighted signals preselected according to an iterative training scheme for a neural network, for providing a plurality of respective weighted fixed length stop description table signals; and summing the plurality of respective weighted fixed length stop description table signals, for providing said remaining response time signal.

5. A method according to claim 2, wherein said subset of input signals represents a corresponding subset of floor/direction combinations along said selected elevator car path, and wherein said step of compiling comprises a step of incrementing a cell in said fixed length stop description table for each floor/direction combination corresponding to a present state of said each floor/direction combination.

6. Apparatus for processing a plurality of input signals representing a state in a building having elevator cars, comprising:

means for providing from the number of the input signals a subset of input signals relating to a corresponding subset of floors along a selected elevator car path in the building;

means for compiling a fixed length stop description table in response to the subset of input signals, for providing fixed length stop description table signals representing a filtered state of the building and that is fixed in length regardless of the size of the building and the number of elevator cars therein;

means for performing the preceding steps for a plurality of elevator cars in the building, for providing a corresponding plurality of remaining response time signals; and means, responsive to the corresponding plurality of remaining response time signals, for assigning a selected elevator car to answer the hall call in the building.

7. An apparatus according to claim 6, wherein said means for compiling compiles the input signals into the fixed length stop description table signals, and stores said fixed length stop description table signals in cells of said fixed length stop description table, and wherein said means for performing responds to said fixed length stop description table signals, for providing a remaining response time signal representing a remaining response time for an elevator car to answer the hall call in the building.

8. An apparatus according to claim 7, wherein said means for performing further comprises:

means for weighting each of the fixed length stop description table signals with respective weighted signals preselected according to an iterative training scheme for a neural network, for providing a plurality of respective weighted fixed length stop description table signals; and means for summing said plurality of respective weighted fixed length stop description table signals, for providing said remaining response time signal.

9. An apparatus according to claim 6, wherein said subset of input signals represents a corresponding subset of floor/direction combinations along said selected elevator car path, and wherein said means for compiling comprises means for incrementing a cell in said fixed length stop description table for each floor/direction combination corresponding to a present state of said each floor/direction combination.

10. A method for estimating a remaining response time for an elevator car in answering a hall call in a building, comprising the steps of:

providing fixed length stop description input signals representing filtered information relating to the elevator car and conditions in the building at a time of a registration of a hall call for an instant assignment, wherein said fixed length stop description input signals are fixed in length regardless of the size of the building and the number of elevator cars therein;

weighting each of the fixed length stop description input signals with weighted signals preselected according to an iterative training scheme for a neural network, for providing weighted fixed length stop description input signals;

summing the weighted fixed length stop description input signals, for providing a remaining response time signal representing information relating to a remaining response time for the elevator car to answer the hall call in the building;

performing the preceding steps for a plurality of remaining elevator cars in the building;

providing a selected remaining response time signal to an elevator assignment module to determine a selected elevator car to answer the hall call in the building; and assigning instantly the selected elevator car to answer the hall call in the building in response to the selected remaining response time signal.

11. A method according to claim 1, wherein the method includes the additional step of:

adjusting periodically said respective weighted signals of the iterative training scheme of the neural network after a predetermined number of iterations until an actual remaining response time output of the neural network substantially matches desired remaining response time output.

12. A method for use in an elevator system using a neural network for estimating a remaining response time for an elevator car in answering a hall call in a building, comprising the steps of:

providing a fixed plurality of filtered building input signals representing filtered information relating to the elevator car and conditions in the building at a time of a registration of a hall call for an instant assignment, wherein said fixed plurality of filtered building input signals is fixed regardless of the size of the building and the number of elevator cars therein;

weighting each of the fixed plurality of filtered building input signals with respective weighted signals preselected according to an iterative training scheme for the neural network, for providing a corresponding plurality of weighted filtered building input signals;

summing the corresponding plurality of weighted filtered building input signals, for providing a remaining response time signal representing information relating to a remaining response time for the elevator car to answer the hall call in the building;

performing the preceding steps for a plurality of remaining elevator cars in the building, for providing a corresponding plurality of remaining response time signals; and assigning instantly a selected elevator car to answer the hall call in the building in response to the corresponding plurality of remaining response time signals.

13. A method according to claim 12, wherein the step of providing the fixed plurality of filtered building input signals includes providing a plurality of fixed length stop description input signals.

* * * * *